US007703553B2

(12) United States Patent
Eddison et al.

(10) Patent No.: US 7,703,553 B2
(45) Date of Patent: Apr. 27, 2010

(54) DOWNHOLE TOOL HAVING RADIALLY EXTENDABLE MEMBERS

(75) Inventors: Alan Martyn Eddison, Stonehaven (GB); Mark Adam, Aberdeen (GB)

(73) Assignee: Andergauge Limited, Aberdeen-Scotland (GB)

( * ) Notice: Subject to any disclaimer, the term of this patent is extended or adjusted under 35 U.S.C. 154(b) by 489 days.

(21) Appl. No.: 10/554,823

(22) PCT Filed: Apr. 26, 2004

(86) PCT No.: PCT/GB2004/001758

§ 371 (c)(1), (2), (4) Date: Dec. 26, 2006

(87) PCT Pub. No.: WO2004/097163

PCT Pub. Date: Nov. 11, 2004

(65) Prior Publication Data

US 2007/0089912 A1 Apr. 26, 2007

(30) Foreign Application Priority Data

Apr. 30, 2003 (GB) ..... 0309906.6

(51) Int. Cl.
*E21B 10/32* (2006.01)

(52) U.S. Cl. ..... 175/269; 175/273; 175/275

(58) Field of Classification Search ..... 175/267, 175/269, 273, 275
See application file for complete search history.

(56) References Cited

U.S. PATENT DOCUMENTS

| | | | | |
|---|---|---|---|---|
| 5,014,780 | A | 5/1991 | Skipper | |
| 5,046,557 | A | 9/1991 | Manderscheid | |
| 5,201,817 | A | 4/1993 | Hailey | |
| 5,351,758 | A | 10/1994 | Henderson et al. | |
| 6,668,949 | B1 * | 12/2003 | Rives | 175/269 |

FOREIGN PATENT DOCUMENTS

| | | |
|---|---|---|
| GB | 872547 | 7/1961 |
| WO | WO 00/31371 | 6/2000 |

OTHER PUBLICATIONS

International Search Report for International Application No. PCT/GB2004/001758 completed Jul. 22, 2004.

* cited by examiner

*Primary Examiner*—William P Neuder
(74) *Attorney, Agent, or Firm*—Alston & Bird LLP

(57) ABSTRACT

A downhole tool comprises a body, radially extendable members mounted to the body and movable between retracted and extended positions, a cam member operatively associated with the extendable members and movable relative to the body to extend the extendable members, and a support member configurable to permit retraction of the extendable members from an extended position. The tool may be an underreamer, and the extendable members may be cutting blades.

63 Claims, 10 Drawing Sheets

10
14
26
30
16
12

14
22
24
18
16
20

14
30
16

110
162
160
156
147
116
132
140
146
114
144

110
166
160
164
156

110
160
147

110
160
114
147
146

110
156
116
132
114

DOWNHOLE TOOL HAVING RADIALLY EXTENDABLE MEMBERS

FIELD OF THE INVENTION

This invention relates to a downhole tool, and in particular to a downhole tool having extendable members, such as an under-reamer, casing cutter or adjustable stabiliser.

BACKGROUND OF THE INVENTION

In the oil and gas exploration and production industry, there are numerous downhole tools that feature radially extendable members. In the case of under-reamers, these members are in the form of blades or cutters that are extended once the under-reamer has passed beyond the end of the existing bore-lining casing, to allow the bore to be drilled beyond the casing to a larger diameter than the internal diameter of the casing. Once the reaming operation has been completed, the blades are retracted to allow the under-reamer, and the rest of the drill string, to be pulled out of the bore. An example of an under-reamer is described in applicant's International (PCT) Application Publication No. WO 00\31371, in the disclosure of which is incorporated herein by reference.

The blades of an under-reamer must be retained in a retracted configuration until the under-reamer has passed beyond the casing, to prevent damage to the casing. The blades may then released and extended. The means for retaining the blades in the retracted configuration should be reliable and secure, as premature extension of the blades is likely to cause significant damage that would be difficult and expensive to remedy. However, this must be balanced with the ability of the operator to release the blades when desired.

Furthermore, the inability, for any reason, to retract the blades of an under-reamer following completion of the under-reaming operation will make it difficult if not impossible to remove the under-reamer from the bore, as the under-reamer will not be able to pass into and through the existing casing. Remedying such a problem, if possible, involves considerable time and expense.

It is among the objectives of embodiments of the present invention to provide an under-reamer having a configuration that facilitates retraction of the under-reamer blades in the event of an operational difficulty.

It is among the objectives of further embodiments of the present invention to provide an under-reamer having a configuration that ensures reliable and secure retention of the under-reamer blades in a retracted configuration and reliable actuation of the blades to an extended configuration.

Other embodiments of the present invention relate to other forms of downhole tool featuring radially extendable members.

SUMMARY OF THE INVENTION

According to a first aspect of the present invention there is provided a downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position.

This aspect of the present invention offers the advantage that the support member permits retraction of the extendable member independently or at least substantially independently of the cam member. This may be useful in circumstances in which the cam member cannot be moved or otherwise operated to allow retraction of the extendable member, for example where the cam member sticks or jams. In downhole operations, for example where the tool is in the form of an underreamer, the extendable member or members, in the form of cutting S blades, are likely to describe a larger diameter than the minimum bore internal diameter above the tool. Thus, if the blades cannot be retracted the tool cannot be removed from the bore, creating significant problems for the operator and requiring time-consuming and expensive remedial action to overcome the resulting problems.

Preferably, the support member is configurable to permit movement of the extendable member relative to at least one of the cam member and the body to permit retraction of the extendable member.

The cam member may take any appropriate form, but is preferably axially movable relative to the body to extend and retract the extendable member. Thus, the support member may be configurable to permit axial movement of the extendable member relative to the cam member.

In embodiments of the present invention, as in a number of existing cam-operated downhole tools, the cam may be incorporated in a part of the string, while the body is incorporated in another part of the string, such that the cam may be moved relative to the body and the extendable member extended or retracted by application of tension or weight to the string. This provides operators with a degree of comfort, as the likelihood of the cam member jamming or sticking relative to the body is low; significant forces may be applied to the cam member, by application of weight from surface and by relying on the weight of the bottom hole assembly (BHA). However, with the present invention, the cam member may be adapted to be movable independently of the string. As noted above, even if such a cam member should jam or stick with the extendable member fully extended, the extendable member may still be retracted. Thus, operators may confidently use tools including such independently movable cam members with the knowledge that the retraction of the extendable member is not dependant on the successful retraction of the cam member.

The cam member may be normally urged towards a position in which the extendable member is retracted, or the tool may otherwise be adapted such that the extendable member is normally retracted. In a preferred embodiment, the cam member is urged to retract the extendable member by a spring.

The cam member may be actuated in any appropriate manner, but is preferably fluid pressure actuated, and most preferably actuated by differential pressure, that is by utilising the difference in fluid pressure between the tool interior and the tool exterior. In a preferred embodiment the cam member is piston actuated, and may incorporate an annular differential piston arrangement whereby fluid within the tool, which fluid may be flowing through the tool and the piston, creates a pressure differential across the piston. Other embodiments may be flow-activated, with cam members operatively associated with nozzles or other flow restrictions.

The support member may be adapted to be maintained in a support configuration; in this configuration the extendable member is extended and retracted solely or primarily by movement of the cam member relative to the body. The support member may be maintained in the support configuration by any appropriate means, including releasable couplings, such as shear pins, or by a spring. In a preferred embodiment the support member is adapted to be maintained in the support configuration at least in part by fluid pressure. In one embodiment the support member is operatively associated with a piston arrangement that, in the presence of appropriate fluid pressure, urges the support member towards the support configuration. The piston arrangement may be adapted to be actuated by a pressure differential between the interior of the tool and the exterior of the tool, or by fluid flowing through the tool. Thus, when the actuating fluid pressure is reduced, the support member may be moved from the support configuration to allow movement of the extendable member relative to the cam member to permit retraction of the extendable member.

Preferably, the extendable member is radially linearly translatable relative to the body, although in other embodiments the extendable member may be rotatable relative to the body, although this tends to limit the opening force which may be applied to the member, which may present difficulties where the tool is a cutting tool and the extendable member is required to cut as it is extended.

The tool according to the present invention may be utilised in a wide range of applications requiring extendable members or blades, including casing cutters and pipe expanders. However, the preferred application for the tool of the present invention is as an underreamer, in which case the extendable members are in the form of blades or cutters. Most preferably, the reaming blades have the facility to cut in both axial directions, that is to ream in one main direction and to back ream in the opposite direction.

The extendable member may be mounted in any appropriate manner in the body, but is preferably located in a window or opening in the body, with sides of the window providing lateral or axial support for the member, depending on the intended use of the tool. In a preferred embodiment, in which the tool is an underreamer, utilised primarily to ream forwards, sides of the body window provide lateral support for the member and a trailing end of the window provides axial support for the member. The support member may extend into the window and provide support for at least one side or end of the extendable member. In a preferred embodiment the support member provides support for a leading face or end of the extendable member. Thus, if the extended member is to be retracted, the tool may be pulled out of the bore until the extended member encounters a bore restriction. This produces an axial force on the extended member, which force is transferred to the support member. Depending on the configuration of the support member, the extendable member is retained in the extended position or is permitted to retract.

Preferably, the cam member defines a cam surface inclined relative to the tool axis, and most preferably the cam surface is at a shallow angle, typically in the region of ten degrees. This provides a large mechanical advantage and thus a high opening or extending force on the extendable member and is also effective in resisting radially acting closing forces; the provision of the support member of the first aspect of the invention becomes more important with such a cam arrangement.

Preferably, the cam member positively engages the extendable member. In one embodiment the cam member and extendable member define corresponding dovetail profiles. Such profiles ensure that the extendable member may be positively withdrawn by the cam member, and forms such as dovetails may be arranged to provide a larger bearing surface than would be possible with plane surfaces. In other embodiments the cam member need not necessarily positively engage the extendable member such that retraction of the extendable member is achieved by application of an external force or by provision of a return spring or the like.

Preferably, the tool is configurable to at least initially restrain or retain the extendable member in the retracted position. This feature is useful in preventing premature or accidental extension of the extendable member; if the tool is an underreamer and is included in a string above a drill bit, while the drill bit is being utilised to drill out a casing shoe it is important the underreamer is not actuated as this would cause the cutters to extend into the existing casing. One or both of the cam member and the extendable member may be lockable, for example by means of a releasable coupling such as a shear pin or ring. In other embodiments the cam member may be mounted to the body by means of a continuous J-slot or barrel cam arrangement or the like which selectively limits the movement of the cam member and requires the cam member to be cycled a predetermined number of times before the cam member is free to move to a position in which the extendable member may be extended. Other embodiments of the invention may incorporate a ratchet arrangement, including the hydraulic ratchet arrangement as described in our earlier application WO 02/075104, the disclosure of which is incorporated herein by reference. Alternatively, where the cam member is fluid actuated an arrangement may be provided for isolating the cam member from fluid pressure or flow, or for negating fluid seals necessary for actuation of the cam member, as will be described below with reference to the third aspect of the invention.

With the extendable member extended, the tool is configured such as to avoid the provision of isolated voids, but which voids may be created as the extendable member is moved towards the retracted configuration. This avoids the difficulties that may occur in tools featuring voids when members are extended; the voids may fill with solid material, known as "packing-off", and then prevent retraction of the extendable member. Certain embodiments of the invention may feature voids, but such voids are not isolated and may, for example, define flow paths such that there is flow of fluid through the voids, thus preventing the build-up of solids in the voids. An embodiment of the present invention features at least one external void, however the tool is adapted to direct a stream or jet of fluid into the void and thus ensure that the void is kept clear. In a preferred embodiment of the invention the tool body is formed to define at least one axially extending channel to facilitate passage of fluid between the exterior of the tool and the surrounding wall of the hole. Most preferably, the at least one axially extending channel is defined, at least in part, by an external void provided to accommodate translation of at least one of the extendable member and the support member relative to the tool body. The void may form part of a pocket in the body. The channel may extend helically, though it is most likely that the part of the channel defined by the void will extend solely axially. Forming the channel in this manner allows the stabilising or centralising surfaces on the body to similarly follow a helical path, and thus provide surfaces that provide a greater circumferential extent and thus provide more effective stabilisation and centralisation than solely axially extending surfaces.

Preferably, the tool features means for indicating that the extendable member has been extended, which means may take any appropriate form. In one embodiment a fluid port may be provided and which port is opened when the member is extended, this being detectable at surface as a drop in back pressure.

According to a second aspect of the present invention there is provided a downhole tool to be incorporated in a string, the tool comprising:

a body adapted for forming part of a string;

at least one radially linearly extendable member mounted to the body and movable between retracted and extended positions;

a cam member operatively associated with the extendable member and movable relative to the body, and independently of the string, to extend the extendable member; and a support member configurable to permit movement of the extendable member relative to at least one of the cam member and the body to permit retraction of the extendable member.

According to a third aspect of the present invention there is provided a downhole tool comprising:

a body;

at least one radially extendable member mounted to the body and movable between retracted and extended positions;

an actuating member operatively associated with the extendable member and adapted to move the extendable member towards the extended position in response to differential fluid pressure; and a seal member having a first configuration in which the actuating member is isolated from differential pressure and a second configuration in which the actuating member is exposed to differential pressure.

This aspect of the invention provides a differential pressure actuated tool in which variations in differential pressure will have little if any impact in the tool actuation until the seal member is appropriately configured. This offers advantages over conventional methods of restraining differential pressure actuated tools, such as shear pins. Differential pressure varies depending on a number of factors, including the depth of the tool and the presence or absence of flow restrictions downstream of the tool. Thus, it may be very difficult to predict the differential pressure that the tool will experience in normal operations, and thus it becomes difficult to select an appropriate shear pin.

The actuation member may be provided in combination with a cam member operatively associated with the extendable member and movable relative to the body to extend the extendable member.

Preferably, the seal member is adapted for movement under the influence of a flow related fluid pressure force. The seal member may be operatively associated with a flow restriction, such that a pressure differential may be established across the restriction. The flow restriction may be in the form of a nozzle. The seal member may be formed such that the pressure differential acts over a relatively large area, most preferably the area of the tool throughbore.

It will be apparent to those of skill in the art that the various features described above may be provided in combination with one or more of the different aspects of the invention, and indeed the features may themselves form further separate aspects of the present invention.

BRIEF DESCRIPTION OF THE DRAWINGS

These and other aspects of the invention will now be described, by way of example, with reference to the accompanying drawings, in which.

5

DETAILED DESCRIPTION OF THE DRAWINGS

Figures 1, 2, 3:
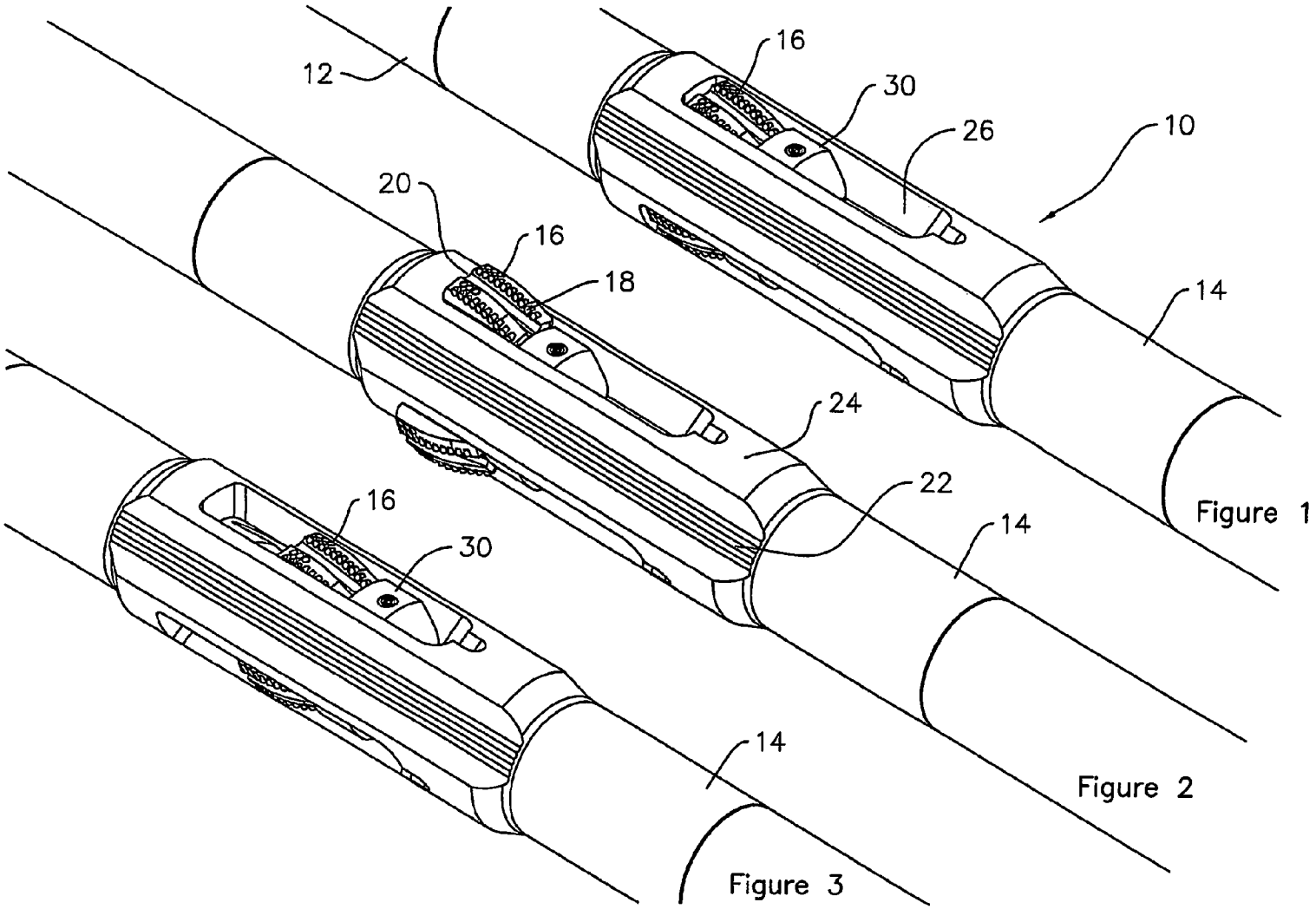
FIG. 1 is a perspective view of a downhole tool in accordance with an embodiment of the present invention, in the form of an under-reamer, with cutting blades retracted.
FIG. 2 is a perspective view of the under-reamer of FIG. 1, showing the cutting blades extended.
FIG. 3 is a perspective view of the under-reamer of FIG. 1, showing the cutting blades in an alternative retracted position.

Reference is first made to FIG. 1 of the drawings, which a perspective view of a downhole tool in accordance with an embodiment of the present invention, in the form of an under-reamer 10. As will be described, the under-reamer 10 is adapted to be incorporated in a drill string 12 and will typically be located in the string 12 above a drill bit (not shown). As such, the under-reamer 10 may be utilised to increase the diameter of a "pilot" bore created by the drill bit.

The under-reamer 10 comprises a generally cylindrical body 14 formed of an appropriate number of sections as required to facilitate manufacture and assembly. As the body 14 is intended for incorporation in a drill string, the ends of the body will be provided with conventional pin and box connections. Within the body 14 are mounted three radially extendable members in the form of blades or cutters 16. When the under-reamer 10 is being run into or out of a hole the cutters 16 are positioned in a retracted position, as illustrated in FIG. 1. For cutting operations, the cutters may be moved to an extended position, as shown in FIG. 2 of the drawings, in which the cutters 16 extend beyond the outer diameter of the body to cut the bore wall. In this embodiment each cutter 16 carries two circumferentially spaced rows of cutting inserts 18, with the cutting inserts 18 describing a smaller diameter towards the leading end of the under-reamer 10. A flute or channel 20 extends between each row of cutting inserts 18 to permit fluid to flow past the trailing row of inserts and keep the cutters 16 clear of cuttings. Flow of drilling fluid and cuttings past the under-reamer 10 is also facilitated by the provision of three channels or flutes 22 between the upset portions of the body 24 which accommodate the cutters 16.

As may be seen from FIGS. 1 to 3, each cutter 16 is located in a respective window 26 in the body 14. In normal conditions, each cutter 16 is located towards the upper or trailing end of the respective window 26 and is supported by and in close engagement with the upper end and sides of the window 26. Indeed, a peripheral wiper seal, located in slot 28 (FIG. 7), may be provided around each cutter 16 to prevent or minimise material ingress and passage around the cutter 16.

The lower or leading end of each cutter 16 engages a respective support member 30 which, as illustrated in FIG. 3, may be moved axially relative to the body 14 to allow the cutter 16 to retract, as will be described.

Figure 4:
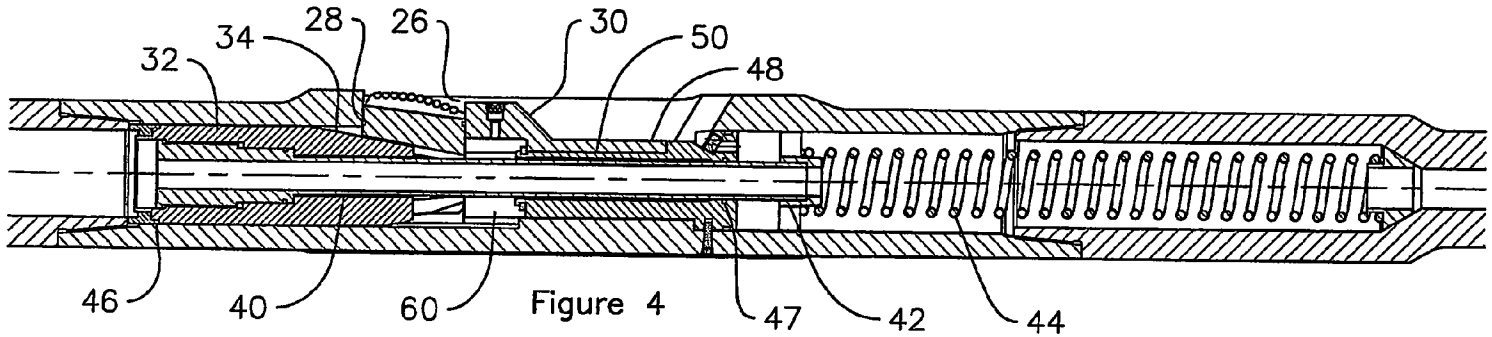
FIGS. 4, 5 and 6 are sectional views of the under-reamer of FIG. 1, 2 and 3.
Figure 5:
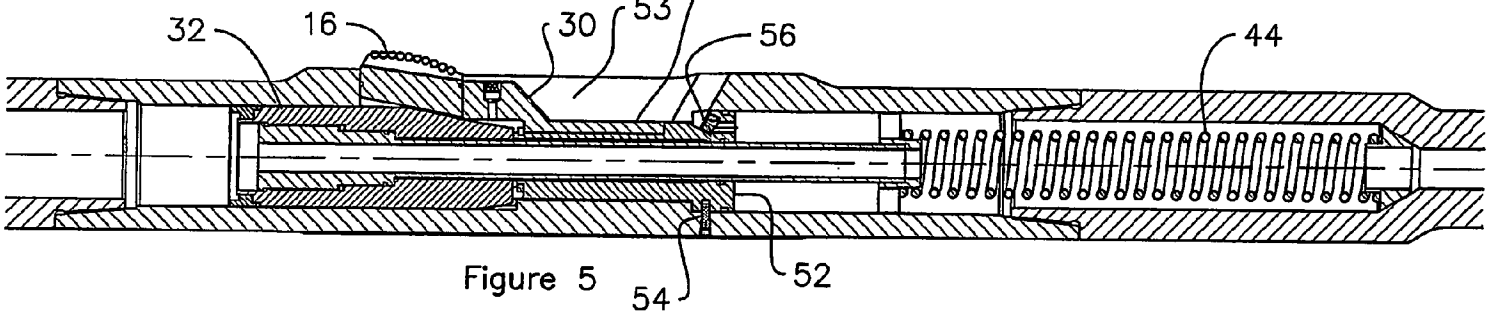
Figure 6:
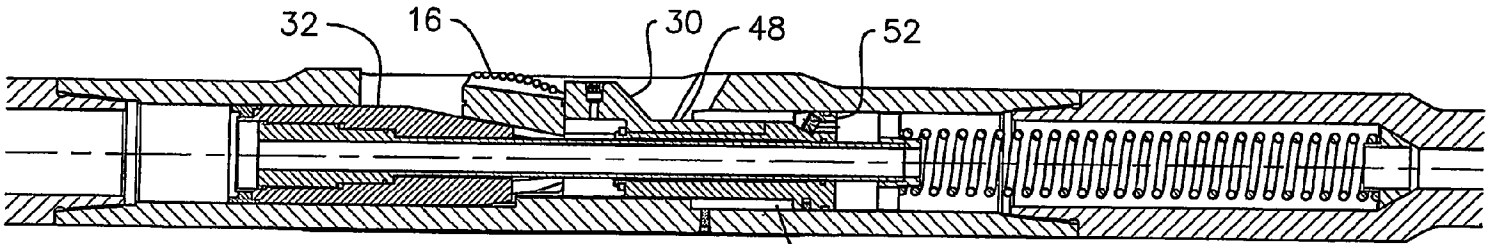
Figure 7:
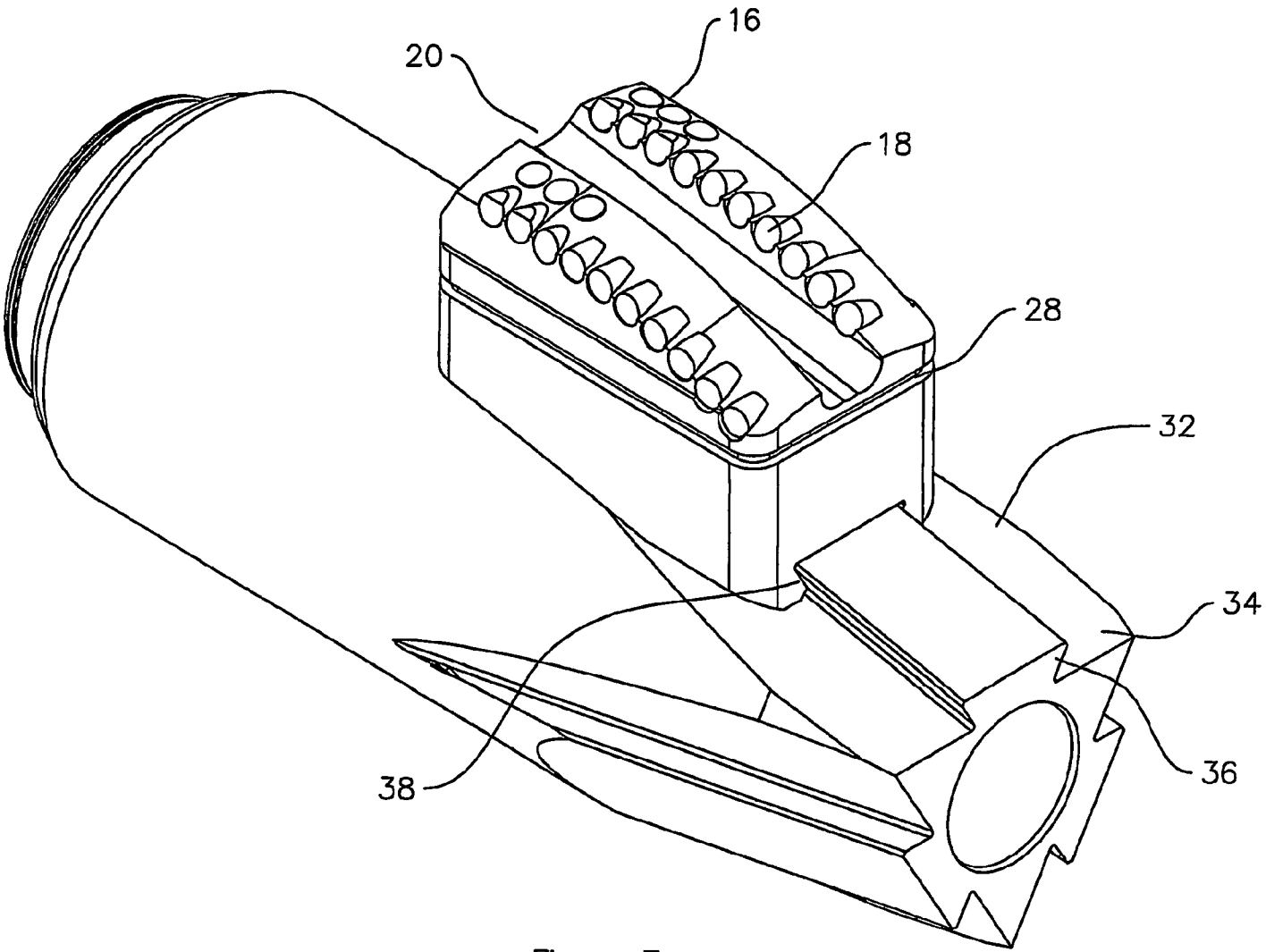
FIG. 7 is an enlarged perspective view of a cutting blade and actuating cam of the under-reamer of FIG. 2.

Reference is now also made to FIGS. 4, 5 and 6 of the drawings, which are sectional views of the under-reamer 10, corresponding to FIGS. 1, 2 and 3, respectively. Reference is also made to FIG. 7 of the drawings, which illustrates a cutter 16 mounted on an actuating cam 32, FIG. 7 illustrating the relative positions of the cutter 16 and cam 32 corresponding to FIGS. 2 and 5.

The cam 32 defines three cam faces 34, each for co-operating with a respective cutter 16. Each cam face 34 defines a dovetail profile 36 that co-operates with a corresponding dovetail slot 38 in the base of the cutter 16. The cam 32 thus positively engages with each cutter 16 and as such may be utilised to both extend and positively retract the cutters 16. Furthermore, use of a dovetail profile also serves to maintain the correct alignment of the cutters 16 relative to the cam 32.

The cam 32 is tubular and locates in a snug sliding fit within the body 14. Furthermore, the cam 32 is mounted on an elongate tubular sleeve 40 that extends through the body to an end piece 42 that engages with the upper end of a compression spring 44. The arrangement is such that the spring 44 urges the sleeve 40 and cam 32 upward towards the position in which the cutters 16 are fully retracted (FIG. 4).

In use, drilling fluid is pumped through the body 14, and thus through the cam 32 and sleeve 40. This fluid is utilised to create an axial actuating force on the cam 32 by virtue of the differential diameter seals 46, 47, the upper larger diameter seal 46 engaging the inner surface of the body 14 while the lower smaller diameter seal 47 is provided between part of a support member assembly 48 and the outer surface of the sleeve 40.

As noted above, in normal operational conditions, each cutter 16 is located within and supported by an opening defined by the body window 26 and the upper end of the support member 30. With the support member 30 in the support configuration, axial movement of the cam 32 in the body 14 produces linear radial movement of the cutters 16. While the upper end and sides of the body windows 26 are fixed, each support member 30 is releasable from the initial support configuration and may slide downwards relative to the body 14 and the cam 32 to allow the cutters 16 to move axially relative to the body 14 and cam 32, and thus retract (FIG. 6).

The support member assembly 48 includes the three support members 30 which extend radially outwardly into the body windows 26. The support members 30 are formed on the upper end of a sleeve assembly 50 which is mounted around the cam sleeve 40 and which includes a lower annular piston 52 that extends between the body internal diameter and the cam sleeve 40. The support member assembly piston 52 is initially fixed relative to the body 14 by a shear pin 54. Furthermore, when the under-reamer 10 is in use and pressurised fluid is flowing through the under-reamer, there is a differential pressure between the fluid within the under-reamer 10 and the fluid in the annulus surrounding the under-reamer such that a differential fluid pressure force acts on the piston 52, which serves to support the assembly 48 in the cutter-supporting position.

It will be noted that from FIGS. 4, 5 and 6 that the piston 52 includes nozzles 56 which are arranged to direct jets of drilling fluid into the windows 26 below the support members 30, thus maintaining the voids 53 free of solid materials and also facilitating cleaning of the cutters 16.

In use, as noted above, the under-reamer 10 is incorporated in a drill string, above a drill bit, and also typically above other drilling tools such as rotary steerable tools and MWD tools. The drill string may be run into a previously cased bore to extend the bore, and in this case the drill bit will be used initially to drill through the shoe at the lower end of the existing casing and also to drill through any cement which has gathered in the lower end of the bore. At this point, the under-reamer 10 will still be located within the existing casing, and it is of course not desirable to extend the cutters 16 at this time. Accordingly, means will be provided for restraining one or both of the cam 32 and the cutters 16, for example an appropriately located shear pin.

Once the drill bit has advanced and the under-reamer 10 is clear of the lower end of the existing casing, the rate of flow and pressure of the drilling fluid may be increased to cause the cam 32 to move axially downwards through the body 14, thus pushing the cutters 16 radially outwards to engage and cut the bore wall as the string is rotated (FIG. 5). The illustrated cam 32 has cam faces 34 at a relatively shallow angle, of around ten degrees. This requires a greater degree of cam travel to extend the cutters 16, however the relatively shallow cam angle produces a relatively large radial force on the cutters 16, thus facilitating cutting of the bore wall as the cutters 16 move radially outwards. Furthermore, once the cutters 16 are fully extended, and the under-reamer is being advanced through the bore, the cutter 16 will tend to experience axial forces that tend to create significant inward forces on the cutters 16, which forces are resisted in part by the shallow cam angle and the relatively large support area provided by the cam.

The shear pin 54 and the fluid pressure acting on the support piston 52 tend to maintain the support members 30 in their initial supporting positions. Furthermore, during normal reaming operations the cutters 16 will experience forces that are predominantly axially upward and radially inwards, such that the forces borne by the support members 30 will be relatively low.

Following completion of a reaming operation, if the flow rate and pressure of the drilling fluid is reduced, the spring 44 will extend and move the cam 32 upwards in the body 14, thus retracting the cutters 16 and allowing the under-reamer 10 to be pulled out of the hole.

Reliable retraction of the cutters 16 is facilitated by the absence of internal voids within the under-reamer 10 when the cutters 16 are extended. Thus, the cutter configuration avoids the situation that may occur when internal voids become filled or packed with solid material, which then prevents retraction of the cutters. As may be noted from FIGS. 4 and 6, voids 60, 61 are present or created when the cutters 16 are retracted, however there are no significant voids present when the cutters 16 are extended.

In the event that a problem is encountered with the cam 32, for example the cam 32 becomes jammed in the extended position as illustrated in FIG. 5, retraction of the cutters 16 may be achieved by reducing the flow rate and pressure of the fluid flowing through the tool, and then picking the tool up and lifting the tool until the extended cutters 16 encounter a restriction. This will create downward and inward forces that will predominantly be resisted by the support members 30. In the absence of a pressure differential across the piston 52, the forces will tend to shear the pin 54, such that the support member assembly 48 is free to move axially downwards relative to the body 14 and the cam 32, such that the cutters 16 may move down the respective cam faces 34 and retract, to the position as illustrated in FIG. 6. The under-reamer 10 may then be removed from the bore.

Those of skill in the art will identify that the above tool configuration provides an effective and reliable means for permitting retraction of extendable cutters even when using a cutter-actuating cam 32, which is independent of the string.

Figure 8B:
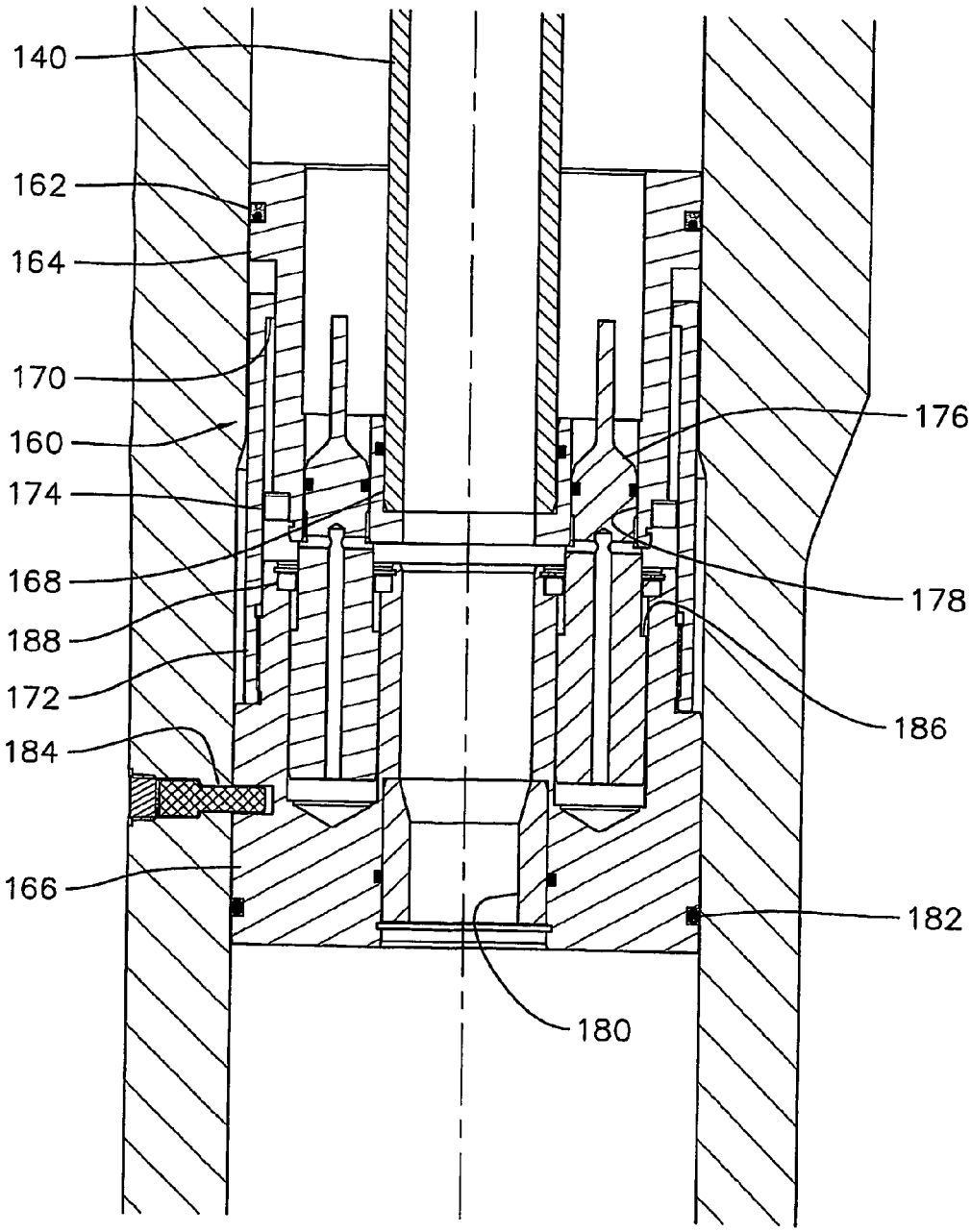
FIGS. 8*b*, 9*b* and 10*b* are enlarged sectional views of a seal member of the tool and corresponding to FIGS. 8*a*, 9*a* and 10*a*, respectively.
Figure 9B:
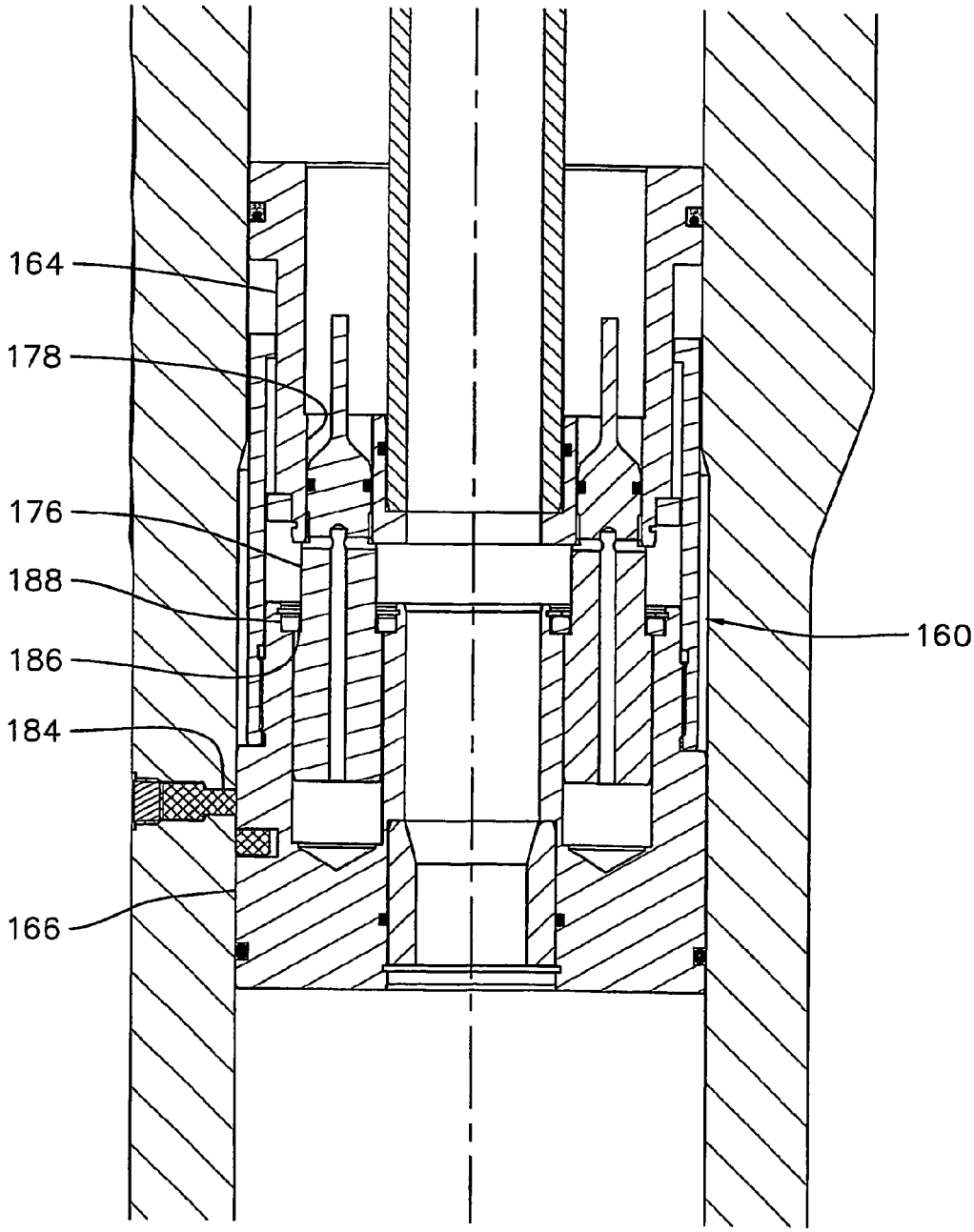
Figure 10B:
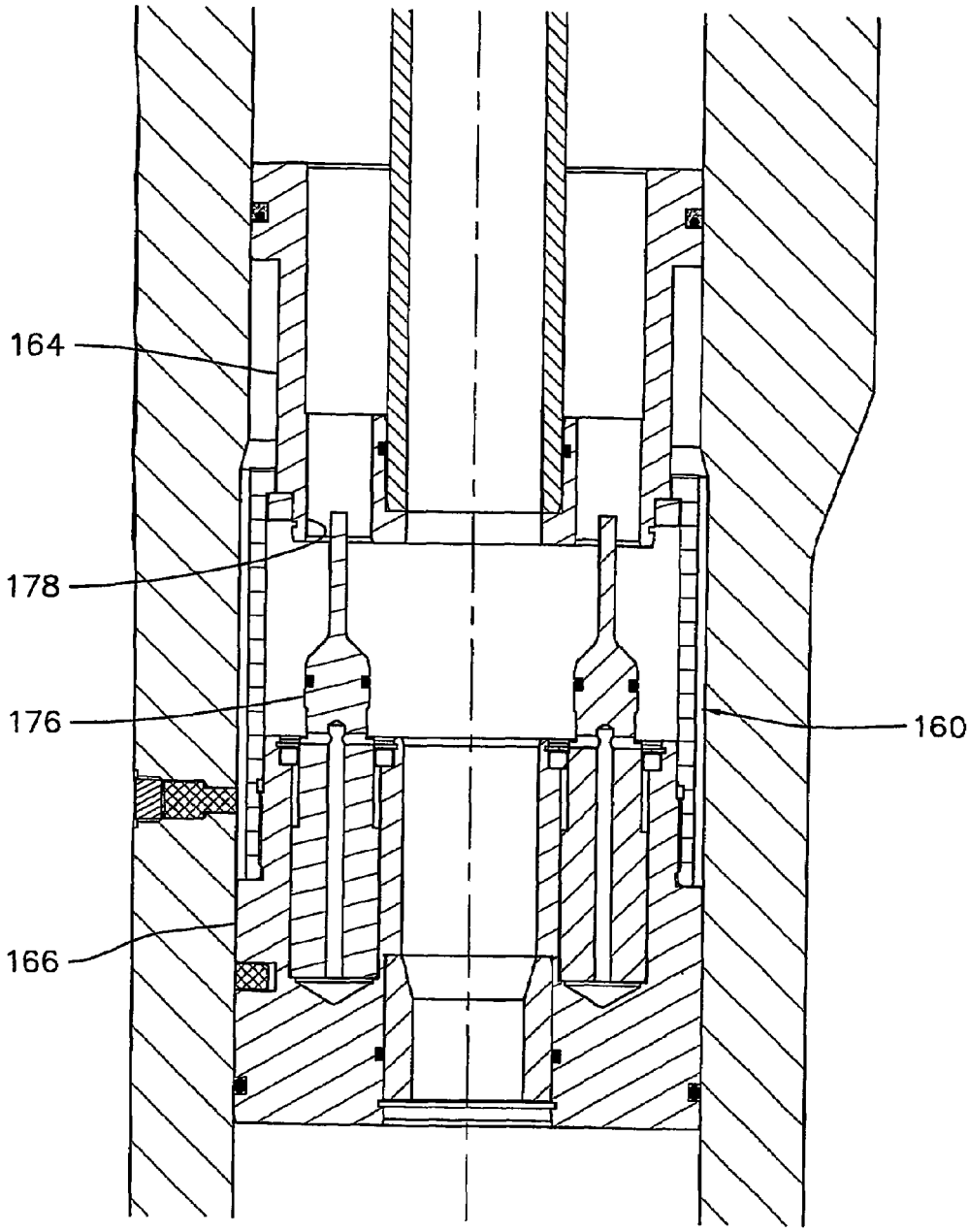
Figures 8A, 9A, 10A, 11A, 12A:
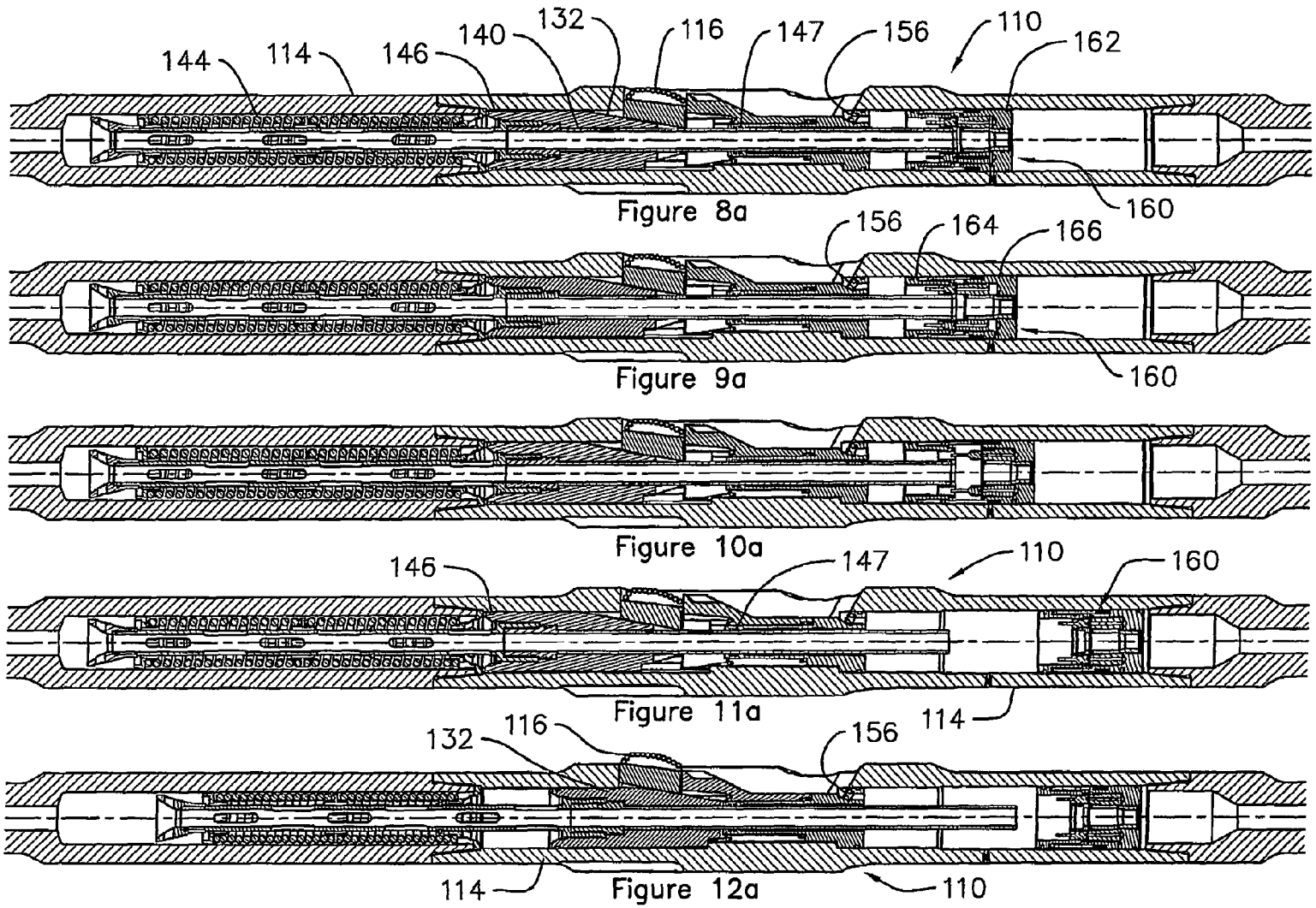
FIGS. 8*a*, 9*a*, 10*a*, 11*a* and 12*a* are sectional views of a downhole tool in accordance with a further embodiment of the present invention, showing the tool in different configurations.

Reference is now made to FIGS. 8*a*, 9*a*, 10*a*, 11*a* and 12*a* of the drawings, which are sectional views of a downhole tool, in the form of an under-reamer 110, in accordance with a further embodiment of the present invention, showing the tool in different configurations, and also to FIGS. 8*b*, 9*b* and 10*b* of the drawings, which are enlarged sectional views of a seal member 160 of the tool 110 and corresponding to FIGS. 8*a*, 9*a* and 10*a*, respectively. The tool 110 shares many of its features with the tool 10 described above, and those features will not be described again in any detail.

In this embodiment the cam 132 for extending and retracting the cutters 116 is mounted on an elongate sleeve 140 that extends through the tool body 114. The upper end of the sleeve 140 passes through and is coupled to the upper end of a compression spring 144 that normally urges the sleeve 140 and cam 132 towards the position in which the cutters 116 are fully retracted (FIG. 8*a*). The lower end of the sleeve 140 is initially in sealing engagement with a seal member 160 which, in an initial configuration, serves to isolate and negate the effect of the piston created by the differential diameter seals 146, 147; the pressure acting over the area defined by the larger diameter seal 146 is substantially balanced by the pressure acting over the similar area defined by the seal 162 of the seal member 160.

The seal member 160, illustrated in greater detail in FIG. 8*b*, is in two main generally cylindrical parts 164, 166, the upper part 164 carrying the seal 162 and having an inner tubular part 168 that sealingly receives the end of the sleeve 140. The seal member parts 164, 166 are coupled together to permit a degree of relative axial movement, limited by engagement of a shoulder 170 on a sleeve 172 extending from the upper end of the part 166 with a ring 174 on the upper part 164 (see FIG. 8*c*). The seal member parts 164, 166 are initially held together by differential pressure acting over the area of smaller circumferentially spaced pistons 176 coupled to the lower part 166 and which extend into corresponding respective cylinders 178 formed in the upper part 164.

The lower part 166 defines a through bore provided with a flow restriction 180, such that flow of fluid through the restriction 180 creates a differential fluid pressure force across the area of the part 166, defined by seal 182.

The seal member 160 is retained in its initial position by a shear pin 184 that extends between the body 114 and the lower part 166. Actuation of the tool 110 is initiated by shearing the pin 184, as described below.

In the initial configuration of the tool 110, as illustrated in FIGS. 8*a* and 8*b*, variations in the differential pressure between the interior of the body 114 and the exterior of the body have no effect on the tool 110; the seal member 160 negates the effect of the differential pressure piston created by the seals 146, 147. However, if the rate of fluid flow, taking into account the density of the drilling fluid being pumped through the tool 110, is increased to create a pressure force across the restriction sufficient to shear the pin 184, the seal member 160 may be reconfigured to allow actuation of the tool 110 and extension of the cutters 116. This allows for more reliable initiation of actuation of the tool 110, as the only two variables for a given restriction 180 are drilling fluid weight or density and flow rate.

Once the pin 184 has sheared, the flow-related differential pressure force on the lower part 166 of the seal member 160 will tend to pull the part 1.66 down and away from the upper part 164, as illustrated in FIGS. 9*a* and 9*b*. As noted above, the upper part 164 is initially retained in an upper position by the pressure differential between the tool interior and the tool exterior; the upper face of the part 164 is exposed to external pressure via the nozzles 156. Initial movement of the part 166 is damped by the pistons 176 being pulled from the part 164 until restrained by piston shoulders 186 engaging rings 188, subsequent movement being damped by the pistons 176 being withdrawn from the cylinders 178, as illustrated in FIGS. 10*a* and 10*b*.

Following withdrawal of the pistons 176 from the cylinders 178, the seal member 160 will simply be pushed downward to land on a shoulder at the lower end of the tool 110, as illustrated in F*igure* 11*a*. Furthermore, once the pistons 176 have been withdrawn from the cylinders 178, the relatively large area piston created by the differential diameter seals 146, 147 is brought into operation, resulting in a significant axial force being applied to the cam 132, which then moves downwards through the body 114 and extends the cutters 116, as illustrated in FIG. 12*a*.

Figure 13:
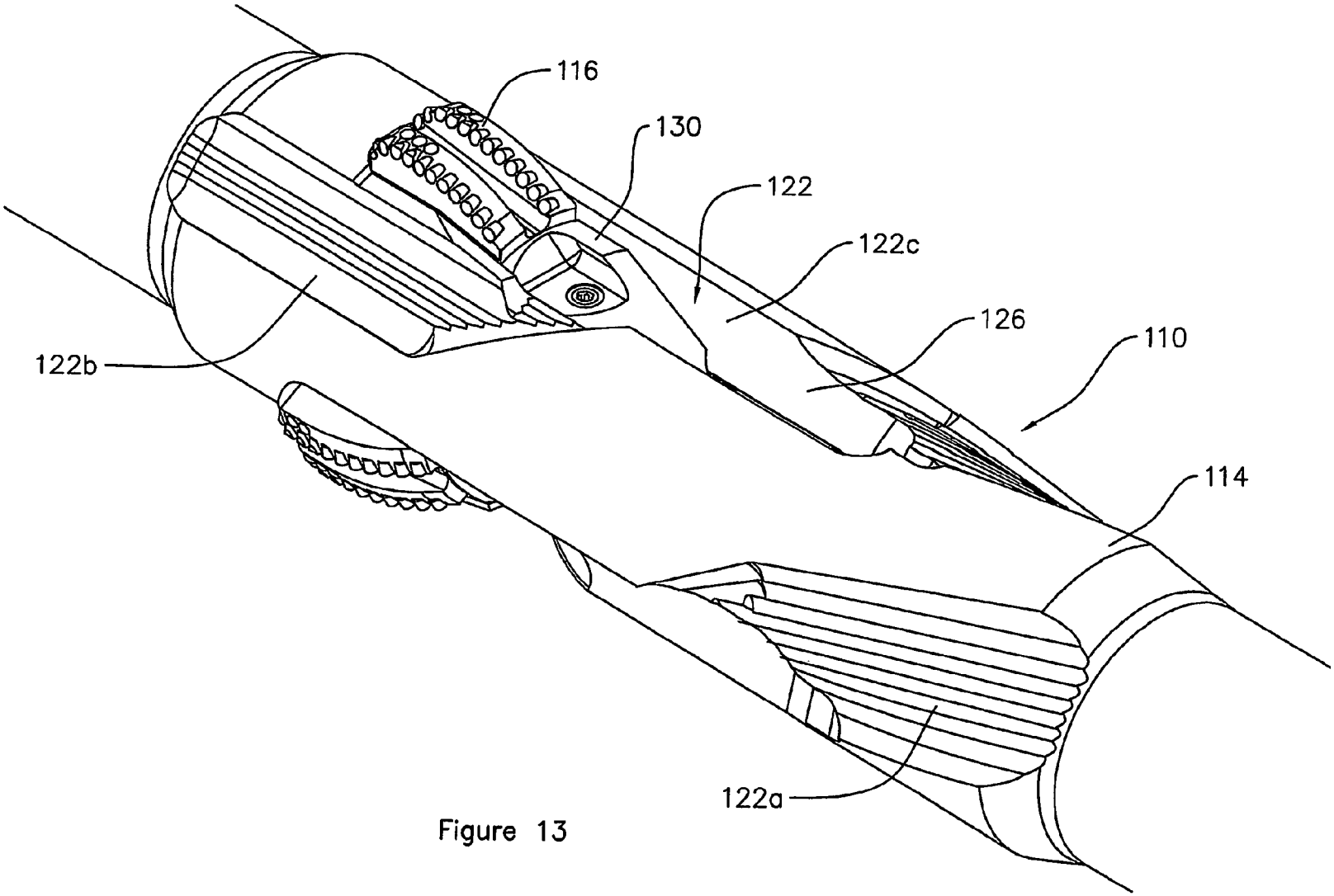
FIG. 13 is a perspective view of the tool of FIG. 12*a*.

While the tool 110 is being operated, drilling fluid in being pumped from surface down through the tool, passing out of the nozzles 156 in the tool 110 and the jetting nozzles in the drill bit below the tool 110, and then passing back to surface via the annulus between the string and wall of the hole. To facilitate passage of the fluid past the tool 110, helically extending channels 122 are formed in the body, as illustrated in FIG. 13 of the drawings. The channels 122 comprise leading and trailing angled surface slots 122*a*, 122*b*, and intermediate axial blade slots 122*c*, formed by the pockets or windows 126 cut in the body 114 to accommodate axial movement of the cutters 116 and cutter supports 130. The surface of the body 110 between the channels 122 is also generally helical, which provides for more effective stabilisation and centralisation than axial surfaces. It will also be noted that the trailing slots 122*b* are formed in front of the cutters 116 and that the thickness of the body is thus greater behind the cutters 116, facilitating support of the cutters 116.

In other aspects of its operation, the tool 110 is substantially similar to the tool 10 described above.

Figure 14A:
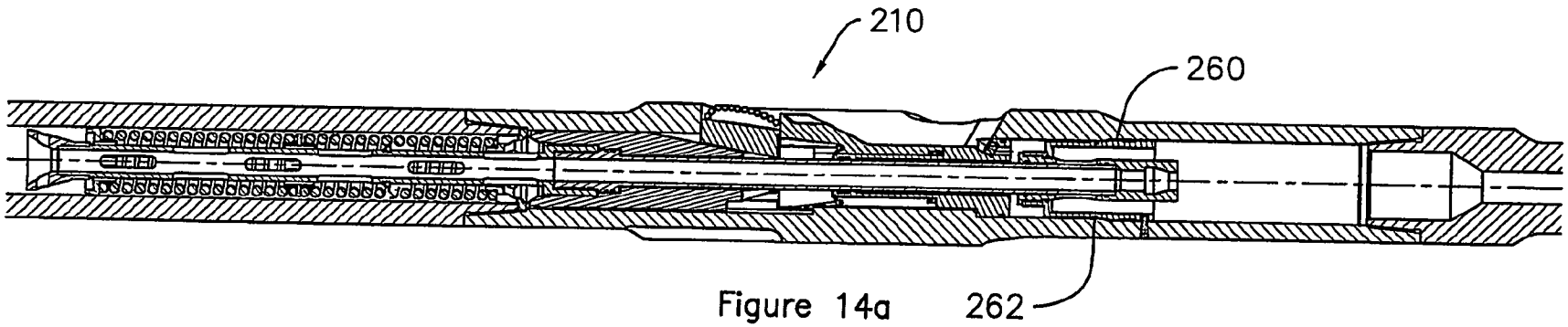
FIGS. 14*a* and 15*a* are sectional views of a downhole tool in accordance with a still further embodiment of the present invention, showing the tool in different configurations.
Figure 15A:
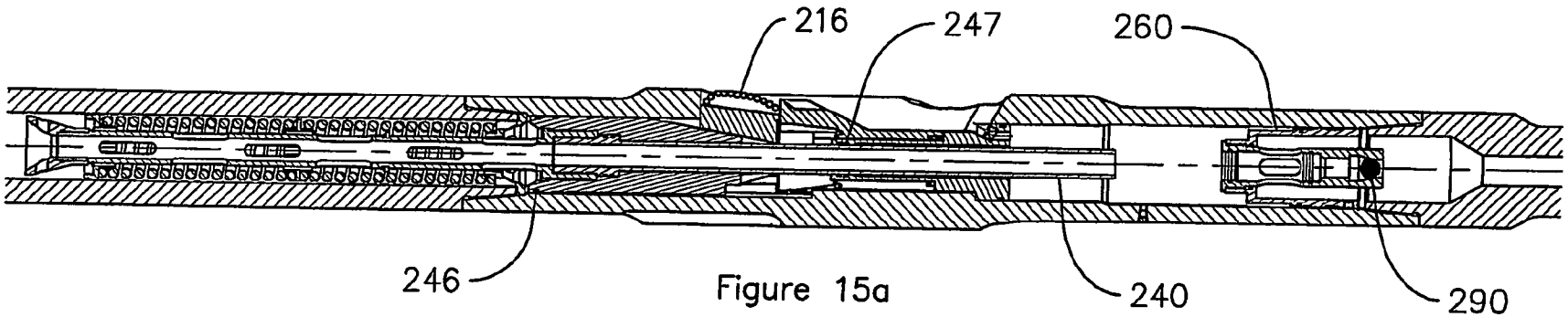
Figure 14B:
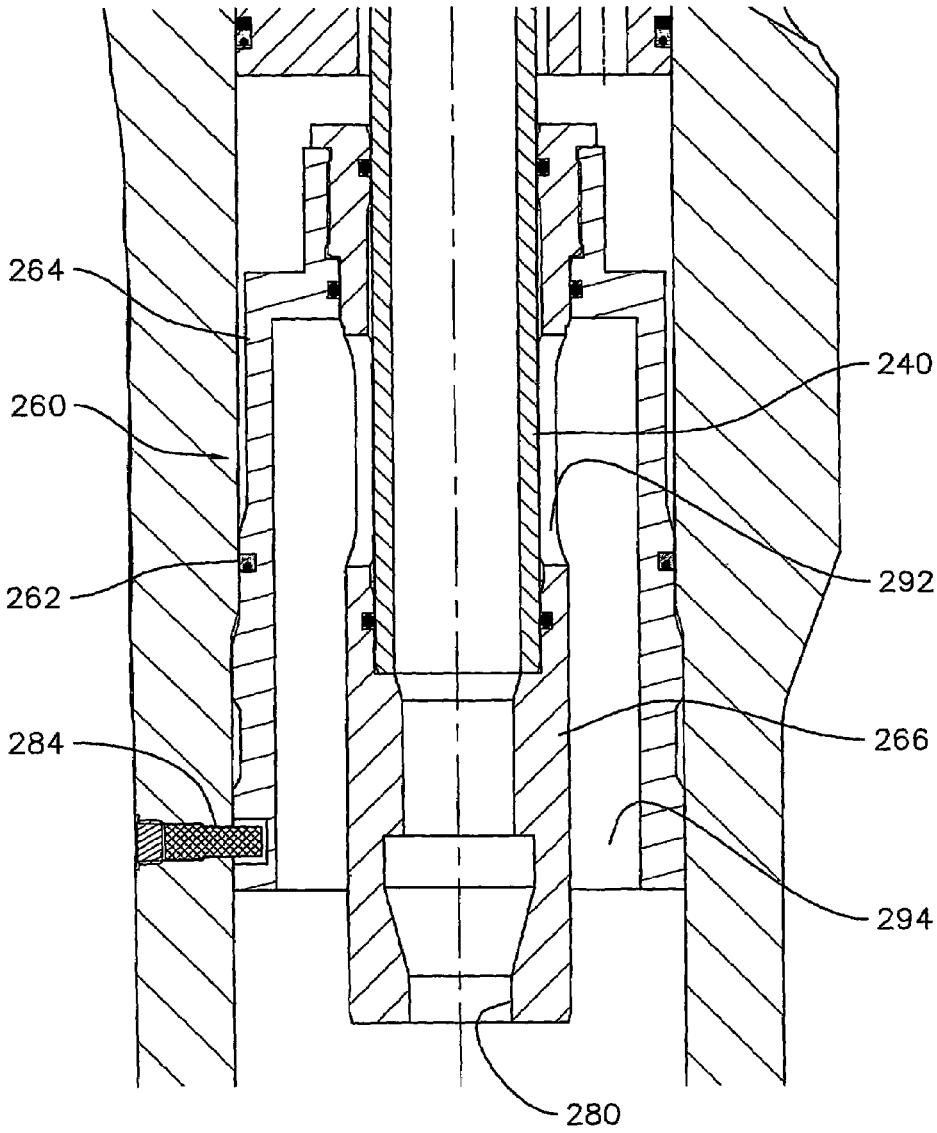
FIG. 14*b* is an enlarged sectional view of a seal member of the tool of FIG. 14*a*.

Reference is now made to FIGS. 14*a* and 15*a* of the drawings, which are sectional views of an under-reamer 210, and also to FIG. 14*b* of the drawings, which is an enlarged sectional view of the seal member 260 of the tool 210. The under-reamer 210 operates in a substantially similar manner to the tool 110 described above, however the tool 210 has a seal member 260 of somewhat simpler construction, and requires a ball 290 to be dropped into the seal member 260 to activate the tool 210. The seal member 260 comprises two main parts 264, 266 which are fixed together, the outer part 264 carrying a seal 262 for engaging the body bore and a lower, larger diameter portion of the part 264 being coupled to the body 214 by the shear pin 284, while the inner part 266 provides the seal with the lower end of the sleeve 240 and also defines a ball-catching restriction 280.

In use, dropping a ball 290 into the tool 210 from surface and applying fluid pressure from surface will create a fluid differential force across the ball and the restriction 290, 280 sufficient to shear the pin 284. The force will then move the seal member 260 downwards, against the pressure differential between the interior and exterior of the tool, until the seal 262 moves into the larger diameter portion of the body bore, and the seal member will then move away and clear the end of the sleeve 240, as illustrated in FIG. 15*a*. The differential piston formed by the seals 246, 247 is then operative, and the cutters 216 are extended.

Once the seal member 260 has cleared the end of the sleeve 240, fluid may bypass the ball 290 by flowing through ports 292 in the part 266 above the restriction 280, and into an annular passage 294 between the parts 264, 266.

It will be apparent to those of skill in the art that the above-described embodiments are merely exemplary of the present invention, and that various modifications and improvements may be made thereto without departing from the scope of the invention.

The invention claimed is:

1. A downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position substantially independently of the cam member;

wherein the cam member is movable relative to the body to an extended position to extend the extendable member, and wherein the support member is configurable to permit retraction of the extendable member from the extended position while the cam member remains in the extended position.

2. The tool of claim 1, wherein the tool is in the form of an underreamer, and the at least one extendable member is in the form of a cutting blade.

3. The tool of claim 1, wherein the support member is configurable to permit movement of the extendable member relative to at least one of the cam member and the body to permit retraction of the extendable member.

4. The tool of claim 1, wherein the cam member is axially movable relative to the body to extend and retract the extendable member.

5. The tool of claim 4, wherein the support member is configurable to permit axial movement of the extendable member relative to the cam member.

6. The tool of claim 1, wherein the body is adapted to form part of a tubing string and the cam member is adapted to be movable independently of the string.

7. The tool of claim 1, wherein the cam member is normally urged towards a position in which the extendable member is retracted.

8. The tool of claim 7, wherein the cam member is urged to retract the extendable member by a spring.

9. The tool of claim 1, wherein the cam member is adapted to be actuated by fluid pressure.

10. The tool of claim 9, wherein the cam member is adapted to be actuated by differential pressure.

11. The tool of claim 10, wherein the cam member comprises an annular differential piston arrangement whereby fluid within the tool creates a pressure differential across the piston relative to fluid externally of the tool.

12. The tool of claim 1, wherein the support member is adapted to be maintained in a support configuration in which the at least one extendable member is extended and retracted by movement of the cam member relative to the body.

13. The tool of claim 12, wherein the support member is maintained in the support configuration by a releasable coupling.

14. The tool of claim 13, wherein the releasable coupling is a shear pin.

15. The tool of claim 12, wherein the support member is adapted to be maintained in the support configuration at least in part by fluid pressure.

16. The tool of claim 15, wherein the support member is operatively associated with a piston arrangement that, in the presence of appropriate fluid pressure, urges the support member towards the support configuration.

17. The tool of claim 16, wherein the piston arrangement is adapted to be actuated by a pressure differential between the interior of the tool and the exterior of the tool.

18. The tool of claim 1, wherein the extendable member is radially linearly translatable relative to the body.

19. The tool of claim 1, wherein the at least one extendable member is a reaming blade adapted to cut in both axial directions.

20. The tool of claim 1, wherein the extendable member is located in a window in the body.

21. The tool of claim 20, wherein the sides of the window are adapted to provide at least one of lateral and axial support for the member.

22. The tool of claim 20, wherein the support member extends into the window and provides support for at least one side portion of the extendable member.

23. The tool of claim 22, wherein the support member provides support for a leading face of the extendable member.

24. The tool of claim 1, wherein the cam member defines a cam surface inclined relative to a main tool axis.

25. The tool of claim 24, wherein the cam surface is at a shallow angle to the tool axis.

26. The tool of claim 25, wherein the cam member positively engages the extendable member.

27. The tool of claim 26, wherein the cam member and the extendable member define corresponding dovetail profiles.

28. The tool of claim 1, wherein the tool is configurable to at least initially restrain the at least one extendable member in the retracted position.

29. The tool of any of claim 28, wherein at least one of the cam member and the extendable member is lockable.

30. The tool of claim 29, wherein at least one of the cam member and the extendable member is lockable by means of a releasable coupling.

31. The tool of claim 1, wherein an actuating member is operatively associated with the at least one extendable member and is adapted to move the extendable member towards the extended position in response to differential fluid pressure, and further comprising a seal member having a first configuration in which the actuating member is isolated from differential pressure and a second configuration in which the actuating member is exposed to differential pressure.

32. The tool of claim 31, wherein the actuation member is provided in combination with the cam member.

33. The tool of claim 31, wherein the seal member is adapted for movement under the influence of a flow related fluid pressure force.

34. The tool of claim 31, wherein the seal member is operatively associated with a flow restriction, such that a pressure differential may be established across the restriction.

35. The tool of claim 34, wherein the flow restriction is in the form of a nozzle.

36. The tool of claim 34, wherein the seal member is arranged such that the pressure differential acts over a relatively large area of the seal member.

37. The tool of claim 1, wherein at least one external void is provided in the body to accommodate translation of at least one of the extendable member and the support member relative to the tool body.

38. The tool of claim 37, wherein the tool is adapted to direct a stream of fluid into the void.

39. The tool of claim 1, wherein the tool body defines at least one axially extending channel to facilitate passage of fluid between the exterior of the tool and the surrounding wall of the hole.

40. The tool of claim 39, wherein the at least one axially extending channel is defined, at least in part, by an external void provided to accommodate translation of at least one of the extendable member and the support member relative to the tool body.

41. The tool of claim 40, wherein the channel extends helically.

42. The tool of claim 41, wherein the channel comprises leading and trailing angled surface slots.

43. The tool of claims 42, wherein the trailing slot is formed in front of the extendable member and the thickness of the body is greater behind the extendable member.

44. The tool of claim 40, wherein a plurality of channels are provided and the body surface between the channels is generally helical.

45. A downhole tool comprising:

a body;

at least one radially extendable member mounted to the body and movable between retracted and extended positions;

an actuating member operatively associated with the extendable member and adapted to move the extendable member towards the extended position in response to differential fluid pressure; and a seal member having a first configuration in which the actuating member is isolated from differential pressure and a second configuration in which the actuating member is exposed to differential pressure.

46. The tool of claim 45, wherein the actuation member is provided in combination with a cam member operatively associated with the extendable member and movable relative to the body to extend the extendable member.

47. The tool of claim 45, wherein the seal member is adapted for movement under the influence of a flow related fluid pressure force.

48. The tool of claim 45, wherein the seal member is operatively associated with a flow restriction, such that a pressure differential may be established across the restriction.

49. The tool of claim 48, wherein the flow restriction is in the form of a nozzle.

50. A downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position substantially independently of the cam member;

wherein the extendable member is located in a window in the body, and wherein the sides of the window are adapted to provide at least one of lateral and axial support for the extendable member.

51. A downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position substantially independently of the cam member;

wherein the extendable member is located in a window in the body, and wherein the support member extends into the window and provides support for at least one side portion of the extendable member.

52. The tool of claim 51, wherein the support member provides support for a leading face of the extendable member.

53. A downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position substantially independently of the cam member;

wherein the cam member defines a cam surface inclined relative to a main tool axis.

54. The tool of claim 53, wherein the cam surface is at a shallow angle to the tool axis.

55. The tool of claim 54, wherein the cam member positively engages the extendable member.

56. The tool of claim 55, wherein the cam member and the extendable member define corresponding dovetail profiles.

57. A downhole tool comprising:

a body;

at least one radially extendable member mounted to the body and movable between retracted and extended positions;

a cam member operatively associated with the extendable member and movable relative to the body to extend the extendable member; and a support member configurable to permit retraction of the extendable member from an extended position substantially independently of the cam member;

wherein an actuating member is operatively associated with the at least one extendable member and is adapted to move the extendable member towards the extended position in response to differential fluid pressure, and further comprising a seal member having a first configuration in which the actuating member is isolated from differential pressure and a second configuration in which the actuating member is exposed to differential pressure.

58. The tool of claim 57, wherein the actuation member is provided in combination with the cam member.

59. The tool of claim 57, wherein the seal member is adapted for movement under the influence of a flow related fluid pressure force.

60. The tool of claim 57, wherein the seal member is operatively associated with a flow restriction, such that a pressure differential may be established across the restriction.

61. The tool of claim 60, wherein the flow restriction is in the form of a nozzle.

62. The tool of claim 60, wherein the seal member is arranged such that the pressure differential acts over a relatively large area of the seal member.

63. The tool of claim 62, wherein the tool is adapted to direct a stream of fluid into the void.

* * * * *

UNITED STATES PATENT AND TRADEMARK OFFICE

CERTIFICATE OF CORRECTION

PATENT NO. : 7,703,553 B2
APPLICATION NO. : 10/554823
DATED : April 27, 2010
INVENTOR(S) : Eddison et al.

It is certified that error appears in the above-identified patent and that said Letters Patent is hereby corrected as shown below:

Column 2,

Line 8, "cutting S blades" should read --cutting blades--.

Column 9,

Line 50, "1.66" should read --166--.

Signed and Sealed this

Twenty-first Day of December, 2010

David J. Kappos

David J. Kappos
*Director of the United States Patent and Trademark Office*